US005573027A

United States Patent [19]

Hsiung

[11] Patent Number: 5,573,027

[45] Date of Patent: Nov. 12, 1996

[54] FOLDABLE TENT FRAME STRUCTURE

[76] Inventor: Yu-Kuang Hsiung, Hsi-K'eng No. 1-1, 18 Lin, Tsao-Ch'iao Ts'un, Tsao-Ch'iao Hsiang, Mao Li Hsien, Taiwan

[21] Appl. No.: 411,984

[22] Filed: Mar. 28, 1995

[51] Int. Cl.[6] ..... E04H 15/46

[52] U.S. Cl. ..... 135/142; 135/147; 135/153; 403/331

[58] Field of Search ..... 135/128, 139, 135/140–142, 143, 147, 149, 151, 153, 155, 157, 909, 901, 902, 903; 403/65, 70, 109, 331, 377, 378

[56] References Cited

U.S. PATENT DOCUMENTS

| | | | |
|---|---|---|---|
| 1,305,306 | 6/1919 | Rasmussen | 135/151 X |
| 1,568,239 | 1/1926 | Reilly | 135/147 |
| 3,826,270 | 7/1974 | Hentges | 135/149 X |
| 3,874,398 | 4/1975 | Hendrickson | 135/901 X |
| 4,066,089 | 1/1978 | Rainwater | 135/151 |
| 4,971,474 | 11/1990 | Sprague | 403/331 |
| 5,423,341 | 6/1995 | Brady | 135/139 |

FOREIGN PATENT DOCUMENTS

| | | | |
|---|---|---|---|
| 15851 | of 1887 | United Kingdom | 135/151 |
| 976912 | 12/1964 | United Kingdom | 135/139 |

*Primary Examiner*—Lanna Mai
*Attorney, Agent, or Firm*—Ostrolenk, Faber, Gerb & Soffen, LLP

[57] ABSTRACT

A foldable tent frame includes a parallelepiped structure comprised of a rectangular front sub-frame having four front poles rotatably connected at four front corner members and a rectangular rear sub-frame having four rear poles rotatably connected at four rear corner members and four length-adjustable horizontal poles which are respectively rotatably connect between the front and rear corner members. Each front pole has two sections pivotally connected to a front joint member and each rear pole has two sections detachably connected a rear joint member. Four reinforcing bars respectively rotatably connected to the rear corner members extend diagonally to pivotally joint to a common central joint which includes two halves rotatably relative to each other. A brace pole, comprised of two sections detachably jointed by a joint member, is oriented upright and pivoted at two opposite ends thereof to every two horizontal poles. Each length-adjustable horizontal pole includes a tubular member having two open ends fit into two extension bars rotatably mounted to the front and rear corner members. A retainer in the form of a leaf spring for biasing a projection into holes formed on the extension bar and the horizontal pole to retain the relative position of the latter with respect to the former is provided and is releasable by a release member which has a movable boss to push the projection against the leaf spring for breaking the engagement.

10 Claims, 8 Drawing Sheets

FOLDABLE TENT FRAME STRUCTURE

FIELD OF THE INVENTION

The present invention relates generally to a tent and in particular to a foldable tent frame structure.

BACKGROUND OF THE INVENTION

Outdoor activities, such as camping, need tents as an overnight shelter, especially in rainy seasons. Tents are usually comprised of a frame with a water-proof cover attached thereto. The tent frame is comprised of a number of separate poles. Each of the tent poles may be constituted by two or three segments. These pole segments must be jointed and the poles so formed must be connected and installed to form the frame for expanding the tent cover. Guy ropes and tent pegs are needed for firmly secured the poles and thus the whole tent structure on ground. Such an installation process takes time and labor.

Further, missing one of the poles or one of the pole segments must cause a whole tent useless.

It is therefore to provide a tent frame which comprises a foldable structure capable to be expand with only very limited time and labor and reducing the possibility of losing the parts of the tent frame.

SUMMARY OF THE INVENTION

It is a primary object of the present invention to provide a foldable tent frame structure which comprises pole members connected together by means of foldable joint members so as to be expand and collapse in a time efficient manner and reducing the chance of losing the parts thereof.

It is another object of the present invention to provide a foldable tent frame structure which is capable to be expanded and collapsed by a single person and thus reducing labor required in installing a tent.

It is a further object of the present invention to provide a tent frame structure which has an adjustable base area to provide a more firm structure.

To achieve the above objects, there is provided a foldable tent frame comprising a substantially parallelepiped structure comprised of a substantially rectangular front sub-frame having four front poles rotatably connected at four front corner members and a substantially rectangular rear sub-frame having four rear poles rotatably connected at four rear corner members and four length-adjustable horizontal poles which are respectively rotatably connect between the front and rear corner members. Each of the front poles has two sections pivotally connected to a front joint member and each of the rear poles has two sections detachably connected a rear joint member. Four reinforcing bars respectively rotatably connected to the rear corner members extend diagonally to pivotally joint to a common central joint member which includes two halves rotatably relative to each other. A brace pole, comprised of two sections detachably jointed by a joint member, is oriented upright and pivoted at two opposite ends thereof to every two horizontal poles. Each of the length-adjustable horizontal poles includes a tubular member having two open ends fit into two extension bars rotatably mounted to the front and rear corner members. A retainer in the form of a leaf spring for biasing a projection into holes formed on the extension bar and the horizontal pole to retain the relative position of the latter with respect to the former is provided and is releasable by a release member which has a movable boss to push the projection against the leaf spring for breaking the engagement.

BRIEF DESCRIPTION OF THE DRAWINGS

The present invention will be better understood from the following description of a preferred embodiment of the present invention, with reference to the attached drawings, wherein.

DETAILED DESCRIPTION OF THE PREFERRED EMBODIMENT

Figure 1:
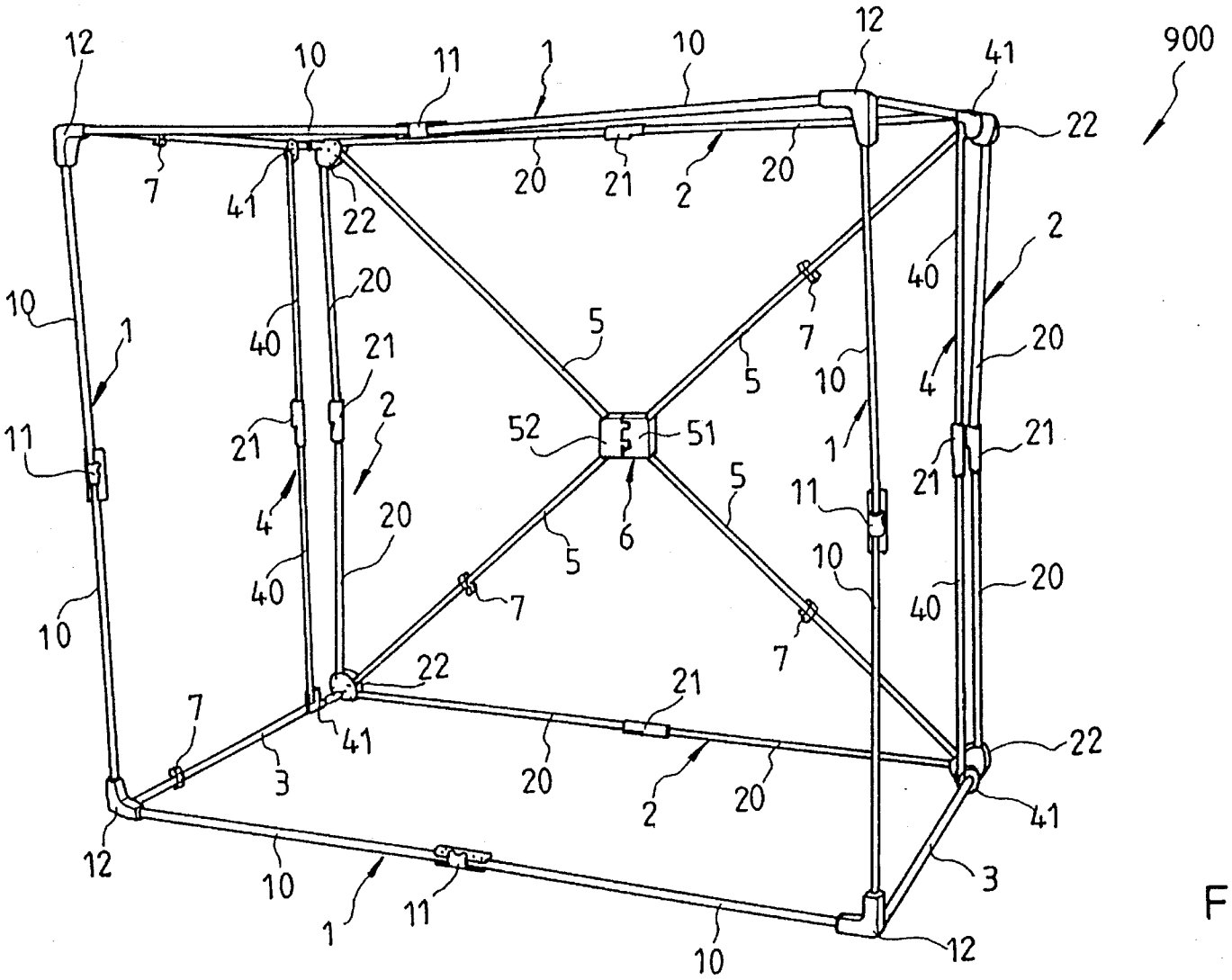
FIG. 1 is a perspective view showing a foldable tent frame structure in accordance with the present invention in a fully expanded condition.
Figure 2:
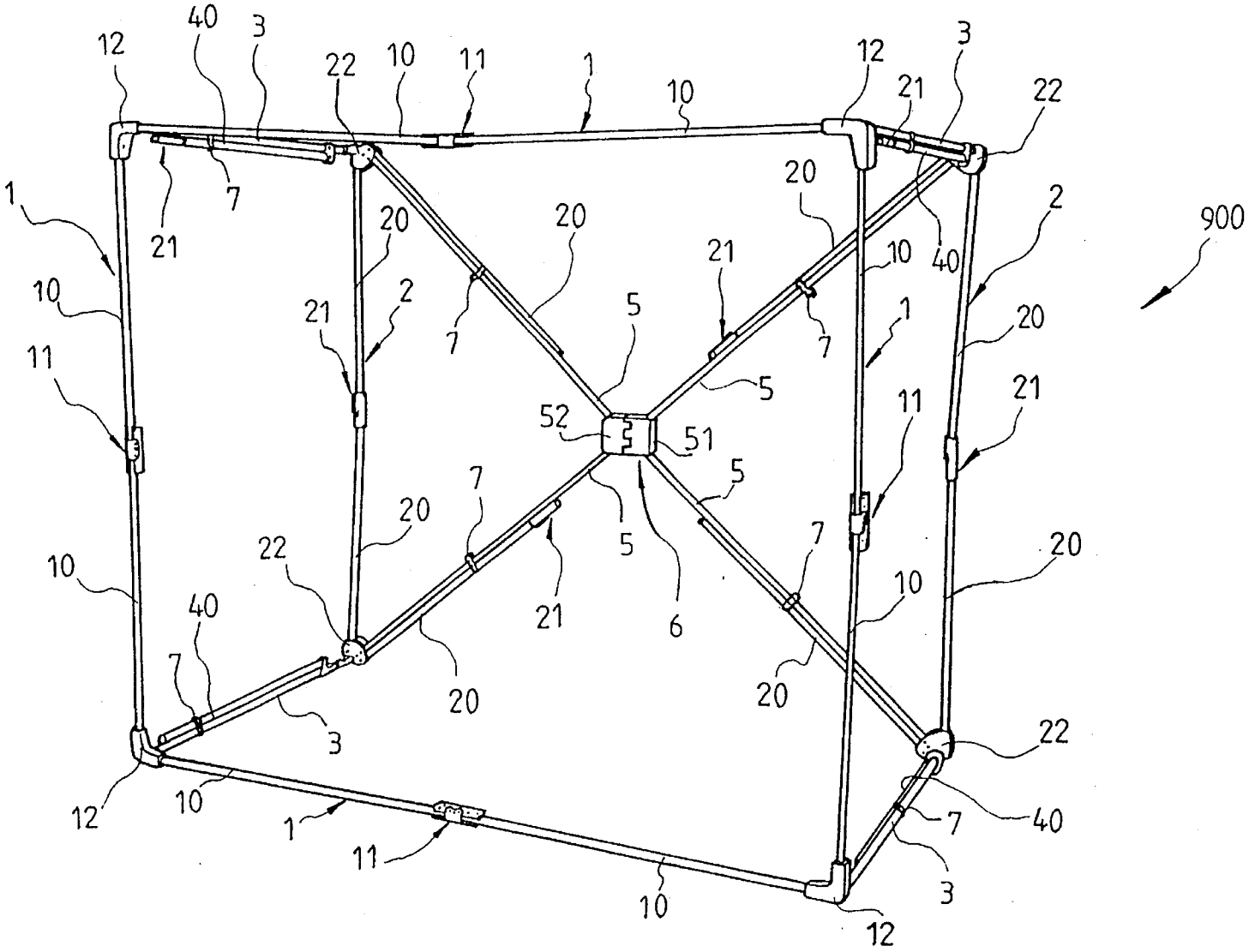
FIG. 2 is a perspective view showing the foldable tent frame structure of the present invention in a partially collapsed condition.
Figure 3:
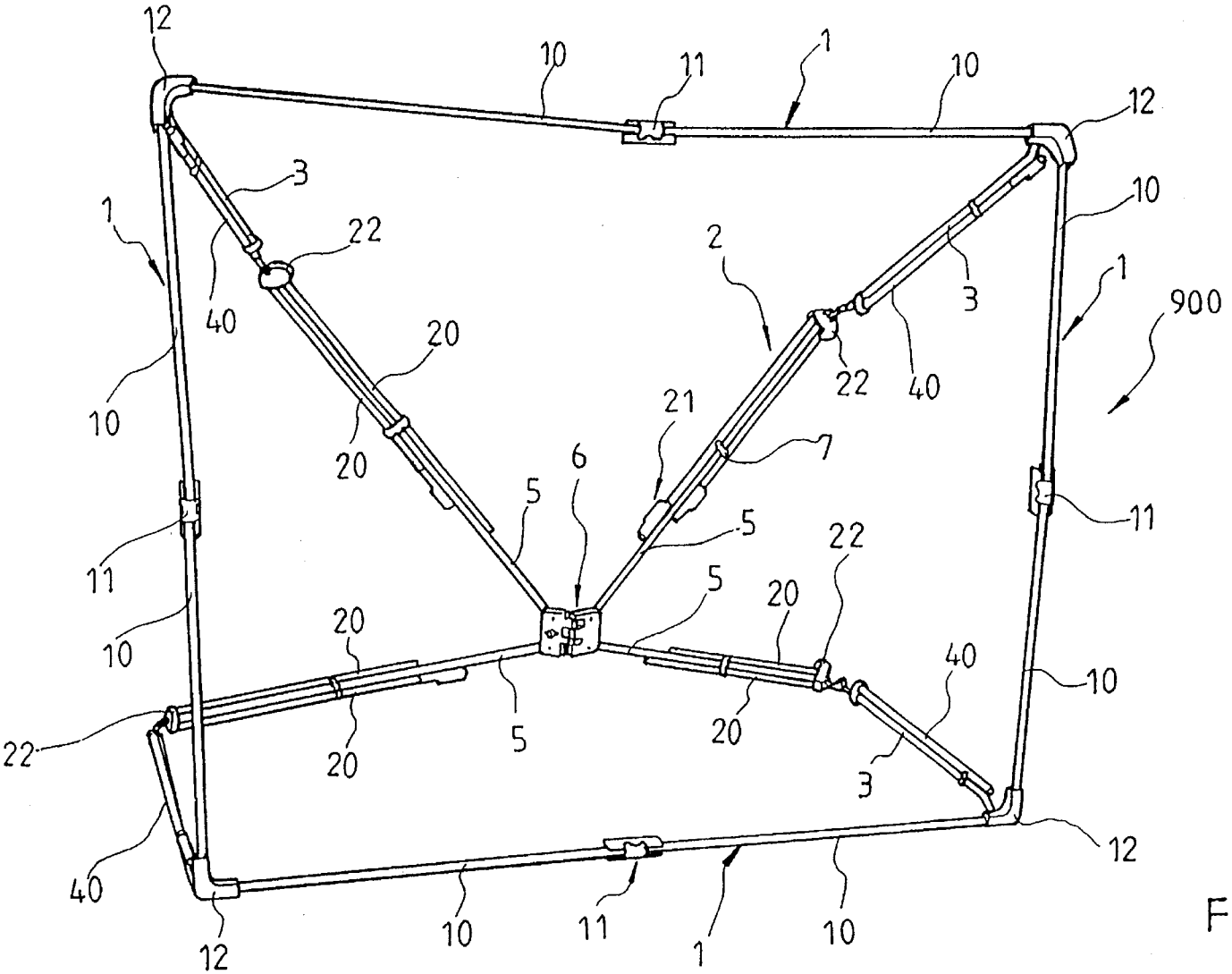
FIG. 3 is a perspective view showing the foldable tent frame structure of the present invention in a further collapsed condition.
Figure 4:
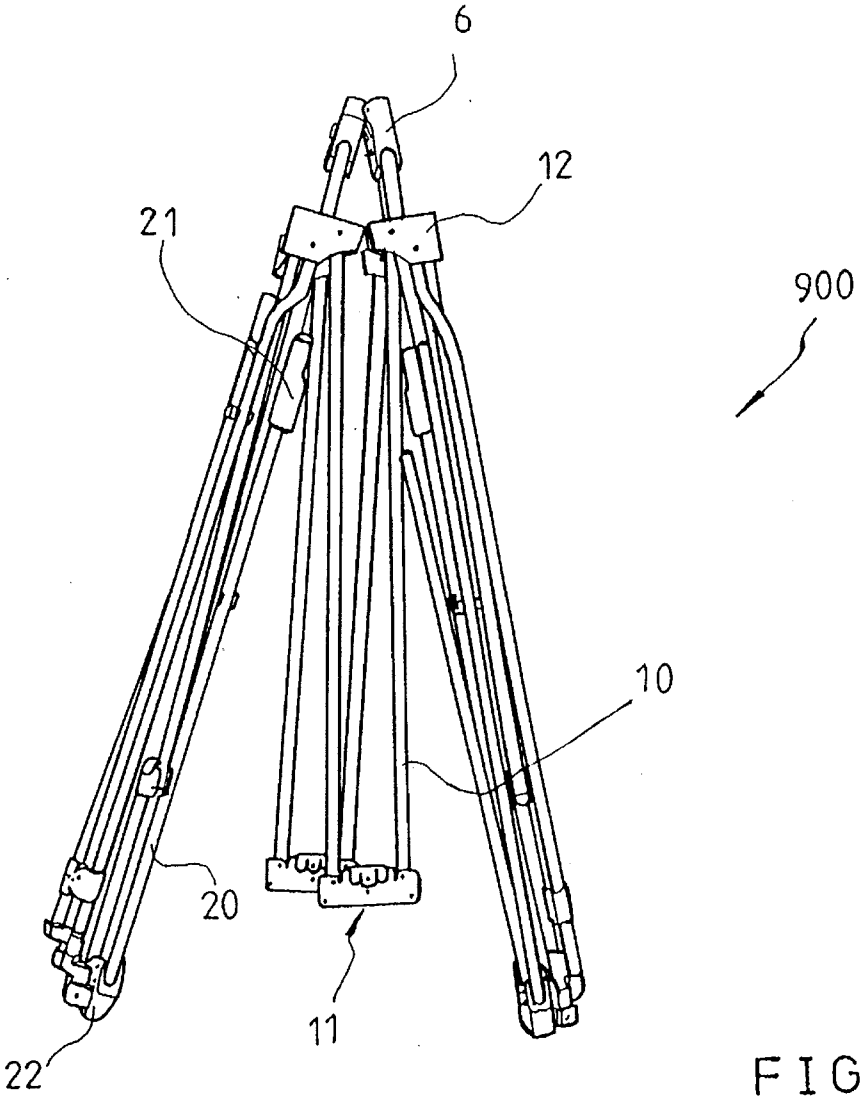
FIG. 4 is a perspective view showing the foldable tent frame structure of the present invention in a fully collapsed condition.

With reference to the drawings and in particular to FIGS. 1–4, wherein a foldable tent frame constructed in accordance with the present invention, generally designated with the reference numeral 900, is shown, the foldable tent frame structure 900 is preferably a substantially parallelepiped structure which is collapsible from a fully expanded condition as shown in FIG. 1 to a fully collapsed condition as shown in FIG. 4. Two partially collapsed conditions of the tent frame structure 900 are shown in FIGS. 2 and 3. The tent frame structure 900 comprises a front sub-frame having four front poles 1 connected together at four front corners of the parallelepiped structure with four front corner members 12 to form a substantially rectangle defining a plane (referred to as front plane hereinafter) when the tent frame 900 is in the fully expanded condition, in which two of the four front poles 1 are oriented upright and two horizontally. Each of the front poles 1 is comprised of two sections 10 foldably jointed at a front joint member 11.

The front joint member 11 may have a known structure, such as the "front joint member" discussed in U.S. Patent application Ser. No. 08/349,086, entitled "COLLAPSIBLE CLOSET FRAME STRUCTURE", which was filed on Dec. 2, 1994 by the applicant of the present invention, and thus will not be further discussed herein. A counterpart application of U.S. Patent application Ser. No. 08/349,086 was filed in Taiwan by the applicant of the present invention and was allowed and published in Taiwan Patent Gazette on Feb. 21, 1995.

Similarly, the front corner members 12 may be of the structure similar to that of the "front corner member" discussed in the above,mentioned U.S. Patent application Ser. No. 08/349,086. Such front joint members 11 are so connected between the two sections 10 of each of the front poles 1 as to allow the sections 10 to be rotatable in a direction off the front plane. No further details of the front corner members 12 and the front joint members 11 will be needed herein.

The foldable tent frame structure 900 further comprises a rear sub-frame, defining a plane (referred to as the rear plane hereinafter) when the tent frame 900 is in the fully expanded condition, having four rear poles 2 of which two are upright and the other two horizontal to be substantially corresponding to and parallel with and spaced from the front poles 1 and jointed together by means of rear corner members 22 to form a substantial rectangle in the fully expanded condition, each rear pole 2 comprised of two sections 20 detachably connected together by means of a rear joint member 21 which is more particularly shown in FIGS. 5–7. The rear sub-frame further comprises a reinforcing bar 5 rotatably connected to each of the rear corner members 22 and diagonally extending therefrom to joint to a central joint member 6 which is substantially centered between the rear poles 2 in a manner that allows the reinforcing bars 5 to be rotatable with respect to the central joint member 6 along the rear plane. The central joint member 6 itself is constituted by two sections 51 and 52 that are rotatable relative to each other about an axis located on the rear plane and substantially parallel with the upright rear poles 2.

The central joint member 6 may have a known structure, such as that of the "brace joint" discussed in U.S. Patent application Ser. No. 08/349,086. Similarly, the rear corner members 22 may be of the structure of the "rear corner member" discussed in U.S. Patent application Ser. No. 08/349,086.

Figure 8:
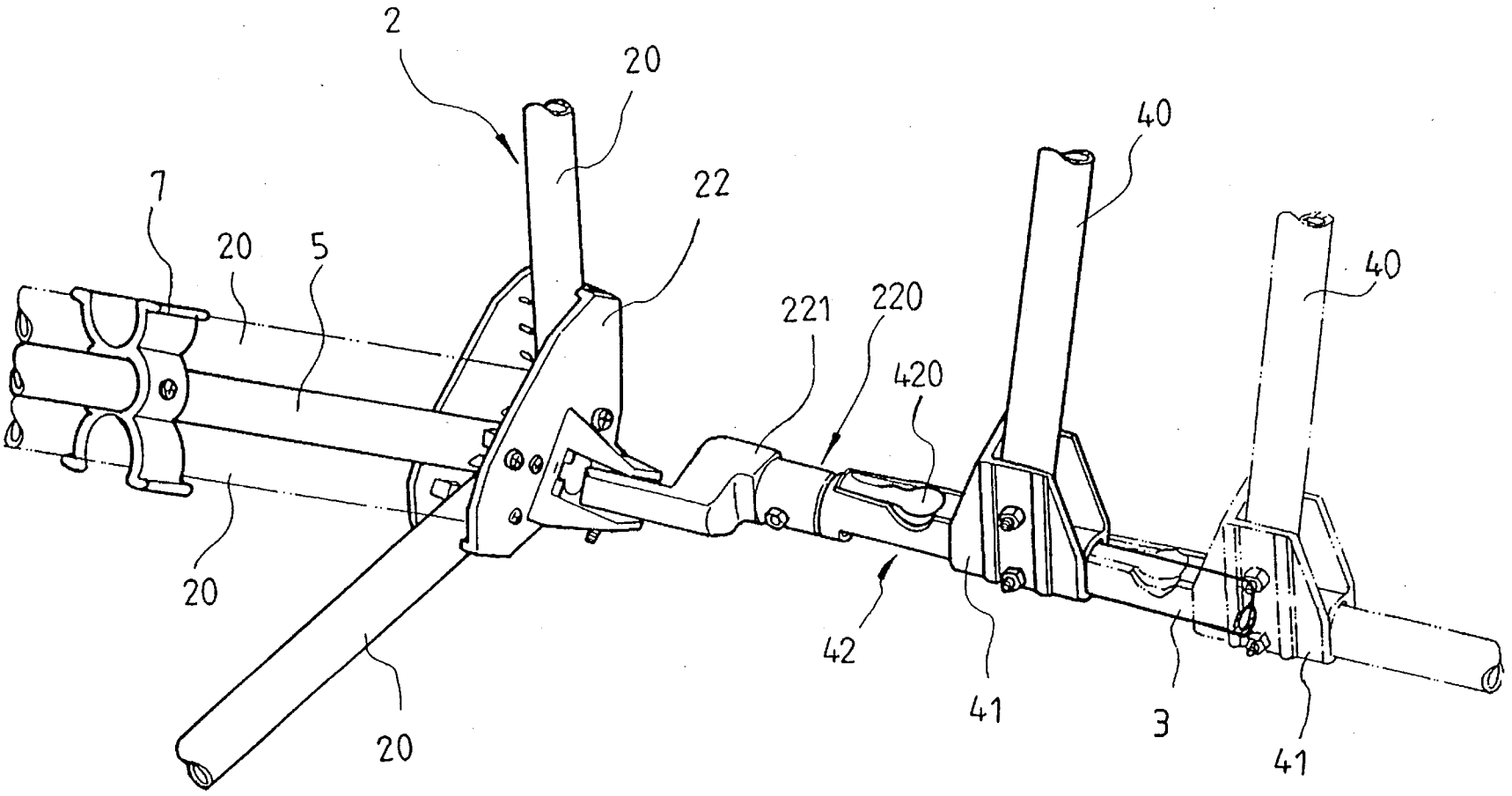
FIG. 8 is a perspective view showing the rear corner member with a portion of two rear poles, a reinforcing bar, a horizontal pole and a brace pole pivoted to the horizontal pole, a holding member being shown mounted to the reinforcing bar.
Figure 9:
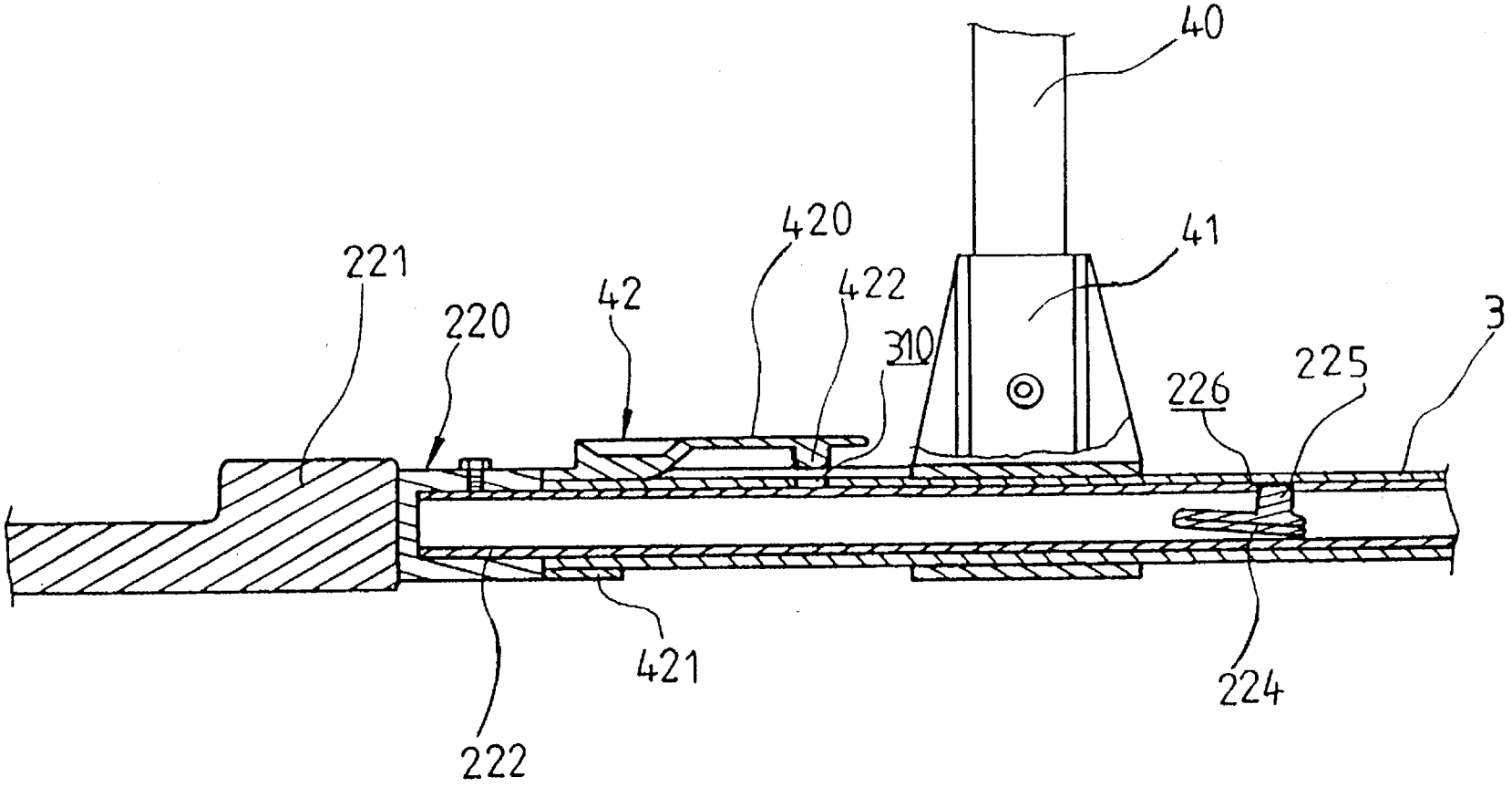
FIGS. 9 and 10 are partial cross-sectional views respectively showing different positions of the fitting connection between the horizontal pole and the extension bar.
Figure 10:
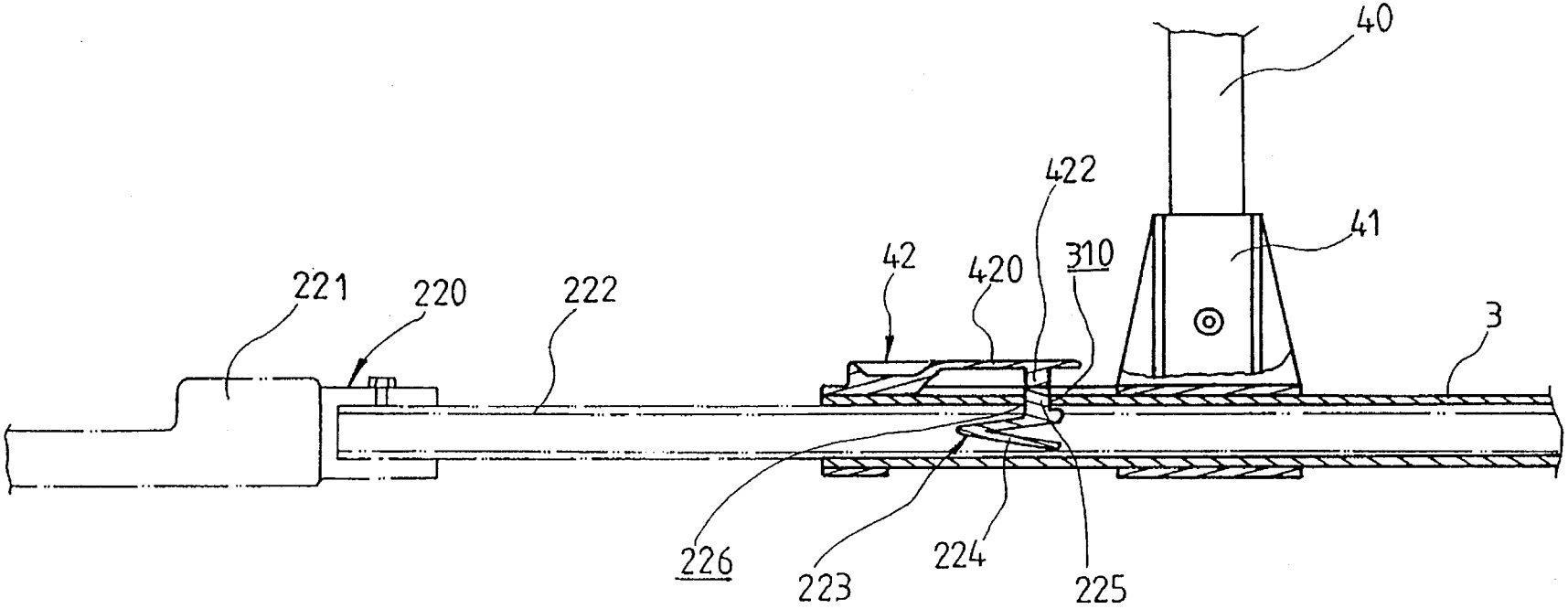

In the expanded condition, the front plane defined by the front sub-frame is substantially parallel with the rear plane defined by the rear sub-frame and the four front corner members 12 are respectively aligned with the four rear corner members 22 and each of the front corner members 12 is connected to the associated rear corner member 22 by means of a horizontal pole 3, which will be discussed in a more detailed manner with reference to FIGS. 8–10, so as to define the parallelepiped structure of the tent frame 900 of the present invention.

Preferably, a holding member 7 is mounted on each of the reinforcing bars 5 at such a location that when the sections 20 of the associated rear poles 2 that are secured to the same rear corner member 22 are detached from the counterpart rear pole sections 20 and rotated about the rear corner 22 to juxtapose the reinforcing bar 5, the sections 20 are engaged by and retained on the reinforcing bar 5 by the holding member 7. The structure of the holding members 7 may be any one of a variety of holding elements that are known to those skilled in the art. An example of the holding members 7 is shown in FIG. 8, in which the dashed line shows the condition where the sections 20 are retained by the holding member 7, while the solid line shows the sections 20 are in the fully expanded condition.

Figure 6:
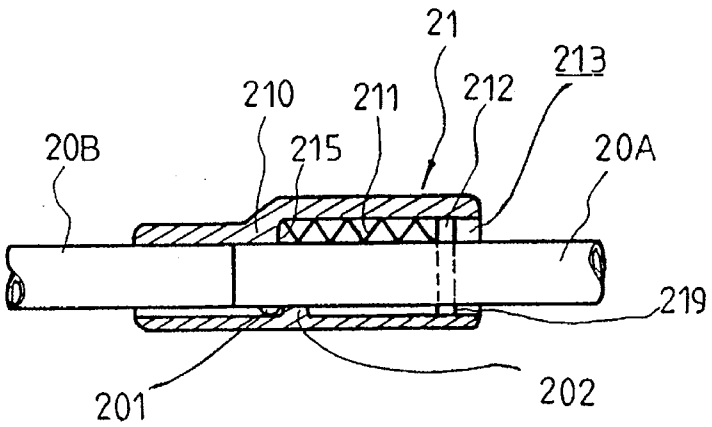
FIGS. 6 and 7 are cross-sectional views of the rear joint member shown in FIG. 5 respectively showing engaged and disengaged positions of the rear joint member.
Figure 7:
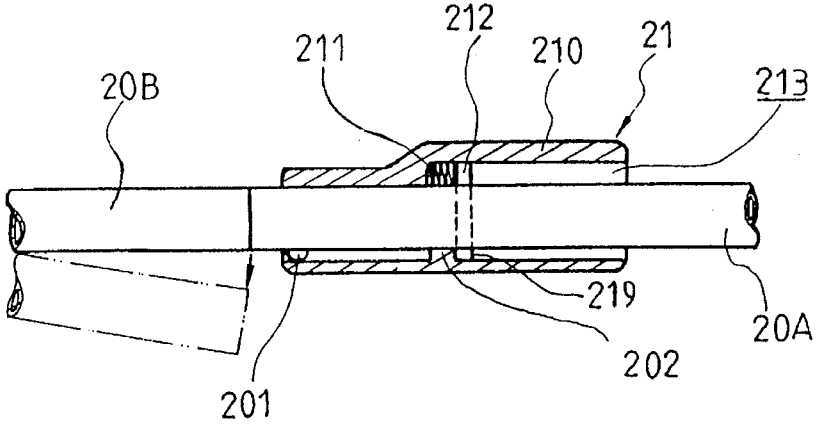
Figure 5:
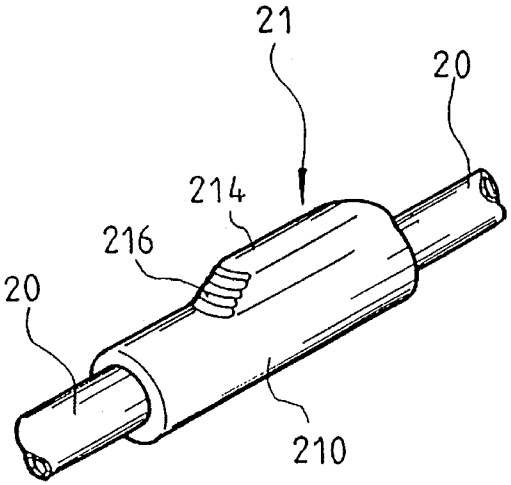
FIG. 5 is a perspective view showing the rear joint member adapted in the foldable tent frame structure of the present invention.

Now referring to FIGS. 5–7, in which the rear joint member 21 is particularly shown, the rear joint member 21 comprises a hollow cylindrical body 210 having two end openings through which the ends of the two sections 20 that constitute the rear pole 2 are received. The body 210 is movably secured on one of the sections 20 in a manner to be described hereinafter so as to allow the other one of the sections 20 disengageable from the body 210. The cylindrical body 210 comprises a raised portion 214, preferably extending along the axis of the rear pole 2 to define a chamber 213 between the cylindrical body 210 and one of the sections 20 to which the body 210 is movably secured, such as the one of the right hand side of FIGS. 6 and 7 which will also be referenced to by the numeral 20A in there drawings. A biasing member, such as a spring 211 is disposed within the chamber 213 having a first end supported by an end wall 215 of the chamber 213 and a second end secured to the section 20A by means of a securing member, such as a pin 212 penetrating through and secured on the section 20A so as to bias the cylindrical body 210 toward the other section 20, which is referenced to as 20B in FIGS. 6 and 7, to allow the cylindrical body 210 to simultaneously fit over the two sections 20A and 20B and thus hold them together in a co-axial manner to form the rear pole 2.

The movement of the cylindrical body 210 toward the section 20B under the action of the biasing spring 211 is constrained by a stop 201 mounted on the section 20A to interact with an inner projection 202 formed inside the cylindrical body 210 so as to allow the cylindrical body 210 to fit over the section 20B a distance sufficient to firmly hold the two sections 20A and 20B in an axially-aligned manner.

The pin 212 that penetrates through the section 20A has a portion 219, also serving as a stop, located in such a position to be cooperate with the inner projection 202 for limiting the movement of the cylindrical body 210 in the direction toward the section 20A while the stop 201 serves to limit the movement of the cylindrical body 210 in an opposite direction, namely the direction toward the other section 20B.

FIG. 7 shows how to release the section 20B from the rear joint member 21. This is done by manually moving the cylindrical body 210 against the biasing spring 211 to allow the end of the section 20B to slide out of the cylindrical body 210. To help manually moving the cylindrical body 210 of the rear joint member 21 against the biasing spring 211, a corrugated portion 216 may be provided on the raised portion 214.

Referring now to FIGS. 1 and 8–10, each of the horizontal poles 3 has two ends, which are preferably formed as open ends or alternatively, the horizontal pole 3 is constituted by a tubular member, respectively connected to one of the front corner members 12 and the associated rear corner member 22 by means of a length-adjustable coupling 220 to have the horizontal pole 3 connected to and extending between the front corner member 12 and the rear corner member 22. The length-adjustable coupling 220 comprises a base 221 pivotally mounted to the front or rear corner member 12 or 22. (In FIG. 8, the base 221 of the coupling 220 is shown connected to the rear corner member 22, yet it is understood that the connection is the same for the front corner member 12.) An elongated extension bar 222 is secured at one end to the base 221, which is connected to one of the front and rear corner members 12 and 22, and extending therefrom toward the other one of the front and rear corner members 12 and 22. The extension bar 222 has a cross-sectional dimension at the other end thereof to be receivable within the open ends of the horizontal pole 3.

The extension bar 222 has formed therein a chamber or is constituted by a tubular member to receive therein a retainer 223 which comprises a biasing member, such as a U- or V-shaped leaf spring 224 having a projection 225 formed on one end thereof and a second end thereof secured or attached to an inner surface of the clamber of the extension bar 222 to bias the projection 225 into a hole 226 formed on the extension bar 222. The horizontal pole 3 has a hole 310 formed thereon to correspond to the hole 226. The hole 310 that is formed on the horizontal pole 3 and the hole 226 that is formed on the extension bar 222 are preferably have the same size to allow the projection 225 to simultaneously enter and remain within both holes 310 and 226.

By moving the horizontal pole 3 relative to the extension bar 222 to have the holes 310 and 226 aligned with each other, the projection 225 is biased by the biasing member 224 to engage hole 310 formed on the horizontal pole 3 and thus retain the horizontal pole 3 and the extension bar 222 in a fixed relative position.

It is quite apparent that there may be provided more than one such retaining hole 226 and the corresponding retainer 223 inside the extension bar 222 and this allows the horizontal pole 3 to have more one relative position with respect to the extension bar 222. Alternatively, more than one such hole 310 may be used.

Retainer release means 42 is provided on the horizontal pole 3 to release the horizontal pole 3 from engagement with the retainer 223 on a specified position or one of a number of specified positions along the length of the extension bar 222. The retainer release means 42 comprises a tubular body 421 press fit over the respective end of the horizontal pole 3 with a floating arm 420 extending therefrom to have a boss 422 formed on a free end of the arm 420 substantially located above the hole 310 formed on the horizontal pole 3. The arm 420 is so rotatable about the junction thereof with the tubular body 421 of the retainer release means 42 to allow the boss 422 to enter the hole 310.

To release the engagement of the projection 225 with the hole 310, the floating arm 420 is pressed by a force acting upon the free end thereof to force the boss 422 into the hole 310 to contact the projection 225. By further pushing the boss 422 to get more deeply into the hole 310 and further enter the hole 226, the projection 225 is forced to disengage from the hole 310 and thus releasing the horizontal pole 3.

By making use of the extension bars 222 in the manner just described, the distance between the front corner member 12 and the associated rear corner member 22 is adjustable and may thus be used to increase the base area that is occupied by the lower side of a fully expanded structure of the present invention. This increases the stability of the tent.

The tent frame 900 of the present invention may also comprises brace poles 4, upright extending between two of the horizontal poles. Each of the brace poles 4 comprises two sections 40, each being pivoted at one end thereof to one of the horizontal poles 3 by means of a connection member 41. The two sections 40 are detachably jointed at the other ends thereof by means of, such as the rear joint member 21 described above. In this way, the sections 40 may be rotatable toward the respective horizontal pole 3 and may then be releasably retained thereon by means of for example the holding member 7 described hereinabove.

Although a preferred embodiment have been described to illustrate the present invention, it is apparent that changes and modifications in the specifically described embodiment can be carried out without departing from the scope of the invention which is intended to be limited only by the scope of the appended claims.

What is claimed is:

1. A foldable tent frame structure comprises a front sub-frame comprising four front poles rotatably connected at ends to four front corner members at four corners and a rear sub-frame comprising four rear poles rotatably connected at ends to four rear corner members at four corners with a length-adjustable horizontal pole rotatably connected to each of the front corner members and the associated rear corner member to have the rear sub-frame spaced from and corresponding to the front sub-frame, each of the rear corner members having a reinforcing bar rotatably connected at one end thereto to extend therefrom in a diagonal direction to rotatably connect to a common central joint member at the other end, the central joint member being constituted by two halves to be rotatable relative to each other, each of the front poles being constituted by two sections with one end thereof rotatably connected to the respective front corner member and the other end pivoted to a front joint member, each of the rear poles being constituted by two sections with one end thereof rotatably connected to the respective rear corner member and the other end detachably connected to a rear joint member, each of the length-adjustable horizontal pole comprising an elongated pole body having two open ends and two opposite extension bars respectively rotatably connected at one end to one of the front corner members and the associated rear corner member to have the other ends slidably fit into the open ends of the pole body, retainer means being provided to retain the pole body at a predetermined position relative to each of the extension bars and release means being provided to break the retaining engagement between the extension bars and the pole body.

2. The foldable tent frame structure as claimed in claim 1, wherein the retainer means comprising at least a first hole formed on each of the open ends of the pole body and each of the extension bars having an inner space with at least a second hole formed on a wall thereof to correspond to the first hole, biasing means being provided within the inner space of the extension bar to bias a boss to pass through the second hole and further into the first hole when the pole body is moved relative to the extension bar to have the first hole aligned with the second hole so as to establish a retaining engagement between the pole body and the extension bar.

3. The foldable tent frame structure as claimed in claim 2, wherein the biasing means comprises a leaf spring with one end secured to the inner space of the extension bar and the boss being mounted to a second end thereof to be biased into the second hole.

4. The foldable tent frame structure as claimed in claim 2, wherein the release means comprises a movable arm mounted to the pole body with a projection formed thereon located substantially above the first hole, the arm being movable relative to the pole body to have the projection move into the first hole for pushing the boss of the retainer means out of the first hole to break the retaining engagement between the pole body and the extension bar.

5. The foldable tent frame structure as claimed in claim 1, further comprising an upright brace pole extending between and rotatably connected every two horizontal poles, each of the brace poles being constituted by two sections each rotatably connected at one end thereof to the horizontal poles and the other ends detachably jointed to each other with a joint member.

6. The foldable tent frame structure as claimed in claim 5, wherein each section of the brace poles is rotatable relative to the respective horizontal pole to juxtapose the horizontal pole and wherein each of the horizontal pole has a holding member mounted thereto to releasably hold the juxtaposing brace pole section.

7. The foldable tent frame structure as claimed in claim 5, wherein each section of the rear poles is rotatable relative to the respective reinforcing bar to juxtapose the reinforcing bar and wherein each of the reinforcing bar has a holding member mounted thereto to releasably hold the juxtaposing rear pole section.

8. The foldable tent frame structure as claimed in claim 1, wherein each of the rear joint member comprises a tubular body movably fit over a first one of the two section that constitute the associated rear pole, the tubular body having an inner projection which cooperates with two spaced stops formed on the first section to limit the movement of the tubular body relative to the first section, a first one of the stops being so located to allow the tubular body to partially slide out of the first section to allow an end of the first section to be completely received within the tubular body and defining an inner space of the tubular body to receive an end of a second one of rear pole sections, biasing means being provided between the tubular body and the first section to bias the tubular body toward the first stop so as to receive the end of the second section therein.

9. The foldable tent frame structure as claimed in claim 8, wherein the biasing means comprises a spring having a first end secured to the first section and a second end secured to the tubular body.

10. The foldable tent frame structure as claimed in claim 8, wherein the tubular body comprises a corrugated portion formed on an outer surface thereof to enhance hand gripping.

* * * * *